US007174968B2

(12) United States Patent
Okunishi et al.

(10) Patent No.: US 7,174,968 B2
(45) Date of Patent: Feb. 13, 2007

(54) HYDRAULIC EXCAVATOR

(75) Inventors: Takayuki Okunishi, Hiroshima (JP); Shinya Nakata, Hiroshima (JP); Hiroshi Shimokakiuchi, Hiroshima (JP); Hiroshi Morita, Hiroshima (JP); Shintaro Sakitani, Hiroshima (JP); Yoshiyasu Umezu, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 108 days.

(21) Appl. No.: 10/852,192

(22) Filed: May 25, 2004

(65) Prior Publication Data

US 2004/0237353 A1 Dec. 2, 2004

(30) Foreign Application Priority Data

May 29, 2003 (JP) ..... 2003-152341

(51) Int. Cl.
*E02F 3/76* (2006.01)

(52) U.S. Cl. ..... 172/819; 172/828

(58) Field of Classification Search ..... 37/409, 37/410, 466; 172/822, 825, 811, 818, 819, 172/828

See application file for complete search history.

(56) References Cited

U.S. PATENT DOCUMENTS 2,502,681 A * 4/1950 Swanson ..... 37/410
2,660,816 A * 12/1953 Maxwell ..... 37/410
2,718,312 A * 9/1955 Pilch ..... 414/694
3,994,349 A * 11/1976 Rockwell ..... 172/814
4,022,282 A * 5/1977 Rockwell ..... 172/1
4,966,240 A * 10/1990 Aikawa ..... 172/825
5,538,216 A 7/1996 Kinzel
6,938,701 B2 * 9/2005 Matsumoto et al. ..... 172/811
2003/0226293 A1 12/2003 Takemura et al.
2004/0237353 A1 12/2004 Okunishi et al.

FOREIGN PATENT DOCUMENTS

JP 11-93209 4/1999
JP 2002-322668 11/2002

OTHER PUBLICATIONS

U.S. Appl. No. 11/103,548, filed Apr. 12, 2005, Okunishi et al.

* cited by examiner

*Primary Examiner*—Victor Batson
(74) *Attorney, Agent, or Firm*—Oblon, Spivak, McClelland, Maier & Neustadt, P.C.

(57) ABSTRACT

The present invention provides a hydraulic excavator provided with a dozer device comprising an arm having a rear end connected to a fulcrum portion provided on a lower frame of a lower traveling body, a dozer blade provided at an extreme end of the arm, and a dozer cylinder for swinging the arm in vertical direction, characterized in that the dozer cylinder and the arm are arranged in a state of forming two sides of a triangle as viewed from the side, the arm swings vertically so that the dozer cylinder does not interfere with a bottom of an upper rotating body rotatably mounted on the lower traveling body, and an approach angle when the dozer blade vertically moved by the arm is placed in the highest position is set to 35 degrees or more, thereby capable of securing travelability equal to an excavator without a dozer device.

6 Claims, 4 Drawing Sheets

HYDRAULIC EXCAVATOR

BACKGROUND OF THE INVENTION

1. Field of the Invention

The present invention relates to a hydraulic excavator provided with a dozer device.

2. Description of the Related Art

Normally, a dozer device provided on a lower traveling body of an excavator carries out a work with its dozer blade placed in contact with the ground. It is also used in case where the dozer blade is pressed against the ground to levitate either forward and backward direction of the lower traveling body to keep an attitude of the excavator on a slope horizontal (for example, Japanese Patent Application Laid-Open No. 2002-322668).

An approach angle of the dozer blade as a climbing angle from the ground is determined so as not to be caught by the ground when climbing a bridge spread between a loading platform of a truck and the ground, and more specifically, the angle is set to approximately 28 degrees. The approach angle is an angle between the ground and a plane in contact, in a tangential direction, with a front circumferential surface of a crawler shoe passing through a lower end of the blade when the blade is raised to an upper limit position.

However, the excavator has a high value that can adjust a leveling work and the attitude of the machine body, whereas has a disadvantage caused by being provided with the dozer device.

For example, it cannot climb over a stacked hill without digging it up as in an excavator not provided with the dozer blade. Further, when traveling along a readjusted slope, the slope is sometimes dug up by the dozer blade.

Furthermore, when climbing on the loading platform of the truck, attention should be paid so as to prevent the dozer blade from being caught by the ground.

SUMMARY OF THE INVENTION

It is an object of the present invention to provide a hydraulic excavator with a dozer device capable of securing a travelability equal to a hydraulic excavator not provided with a dozer device.

The hydraulic excavator according to the present invention has the following fundamental structure.

That is, the hydraulic excavator comprises a lower traveling body having a lower frame, an upper rotating body rotatably mounted on the lower traveling body, an arm one end of which is rotatably connected to the lower frame, a dozer blade connected to the other end of the arm, and a dozer cylinder adapted to support the arm in such a manner that the arm swings in a vertical direction. Further, the dozer cylinder has a function of swinging the arm vertically in the range not to interfere with a bottom of the upper rotating body, the dozer cylinder and the arm are arranged so as to form two sides of a triangle from a side view of the excavator, and an approach angle when the dozer blade vertically moving through the arm is raised to an upper limit position is 35 degrees or more.

In this case, when the dozer cylinder is driven, the dozer blade is raised 35 degrees or more in the range not to interfere with the bottom of the upper rotating body. With this, the travelability becomes equal to the excavator without the dozer device. For example, when climbing a hill or the like, it can run on the hill or the like without breaking them down and travel on the inclined surface of the slope without digging up. When climbing on the platform of a truck, it can climb on the bridge without causing the dozer blade to be caught by the ground.

Furthermore, since the dozer blade can be raised high, where soils are stacked at a corner of a site having walls, the hill can be built in a small space.

DESCRIPTION OF THE PREFERRED EMBODIMENTS

Figure 1:
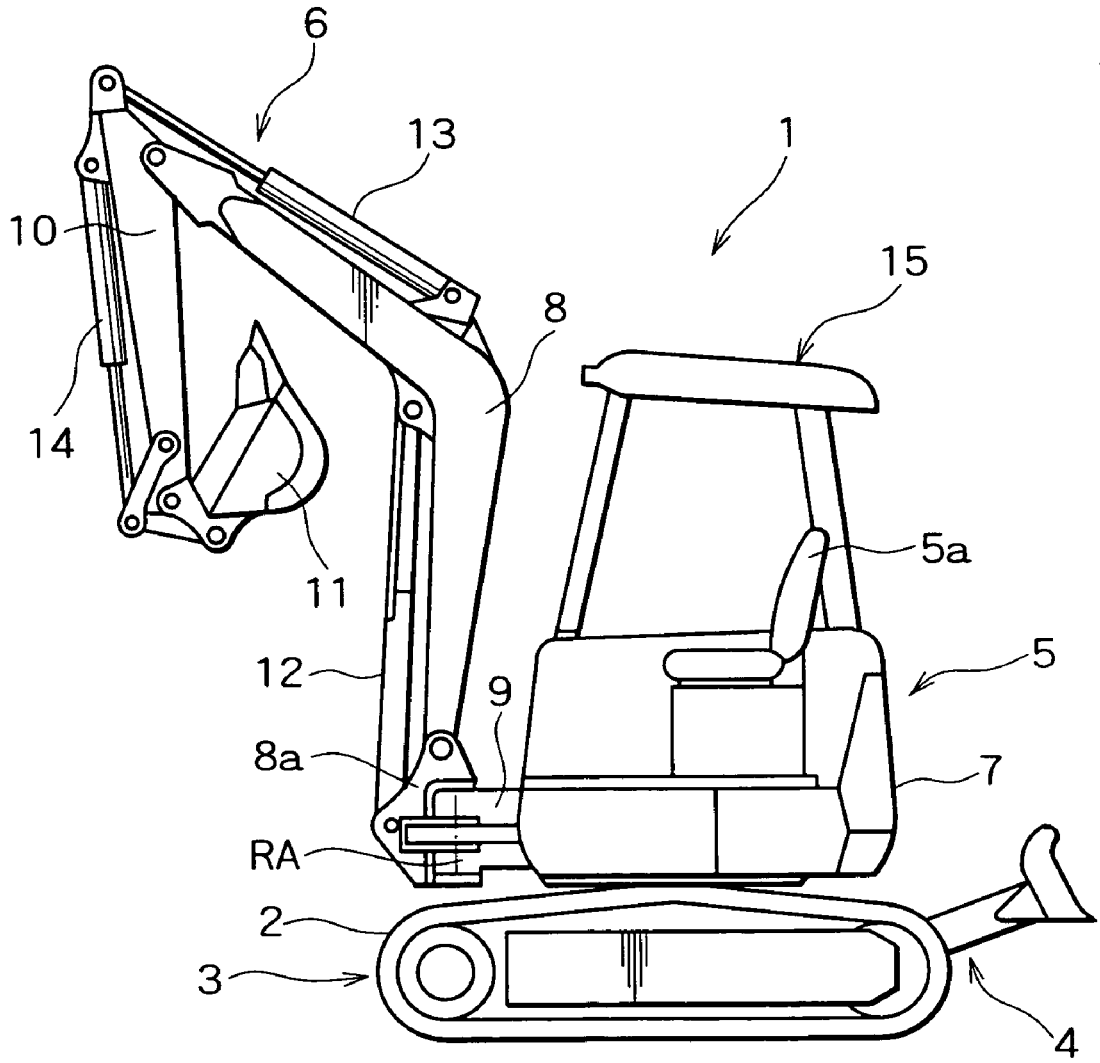
FIG. 1 is a whole view of a hydraulic excavator with a dozer device according to an embodiment of the present invention.

A hydraulic excavator with a dozer device according to the present invention on the basis of the embodiment shown in the drawings will be explaint below.

In FIG. 1, a hydraulic excavator with a dozer device (hereinafter merely referred to as a hydraulic excavator) 1 comprises a lower traveling body 3 on which a crawler shoe 2 mounted as a non-track, a dozer device 4 provided on the lower traveling body 3, an upper rotating body 5 rotatably mounted on the lower traveling body 3, and a front attachment 6 provided in front of the upper rotating body 5.

The upper rotating body 5 is provided with an operator's seat 5*a*, and a counterweight 7 is arranged at the rear of the operator's seat 5*a*.

The hydraulic excavator 1 shown in the present embodiment has a swing boom 8 for swinging the front attachment 6 in a lateral direction. A boom support member 8*a* of the swing boom 8 is connected to a swing bracket 9 extended forward from a main frame (not shown) of the upper rotating body 5.

The boom support member 8*a* is constituted to be rotated about a rotating axis RA by an telescopic operation of a cylinder (not shown) arranged on the right side of the swing bracket 9 so as to swing the front attachment 6 in a lateral direction. Thereby, several kinds of work, such as an excavating work for transverse groove can be carried out.

Reference numeral 10 denotes an arm connected to an extreme end of the swing boom 8, and 11 denotes a bucket connected to an extreme end of the arm 10. Reference numeral 12 denotes a boom cylinder for raising and lowering the swing boom 8, 13 denotes an arm cylinder for swinging the arm in a vertical direction, and 14 denotes a bucket cylinder for swinging the bucket 11 in a lateral direction. Further, numeral 15 denotes a canopy.

Figure 2A:
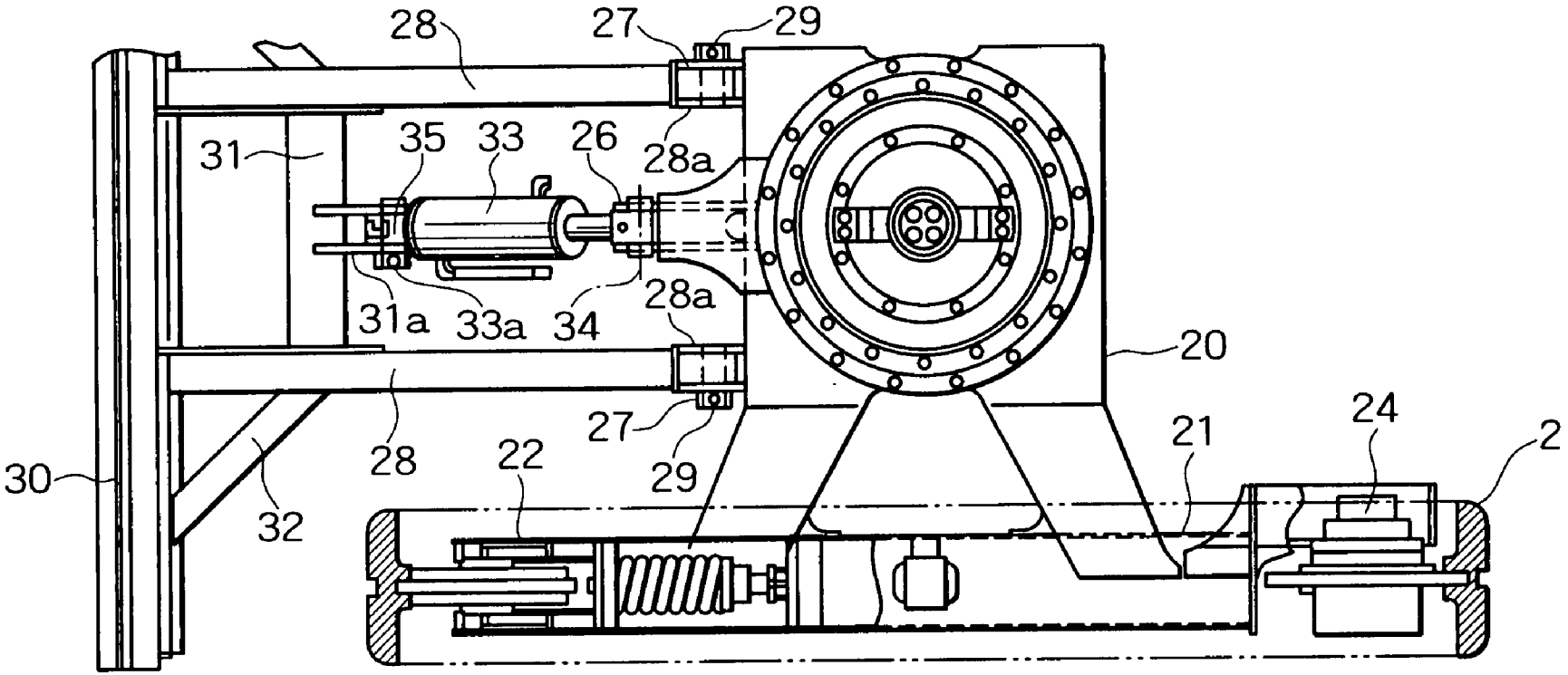
FIGS. 2A and 2B are a plan view and a front view, respectively, showing the dozer device of FIG. 1 enlarged.
Figure 2B:
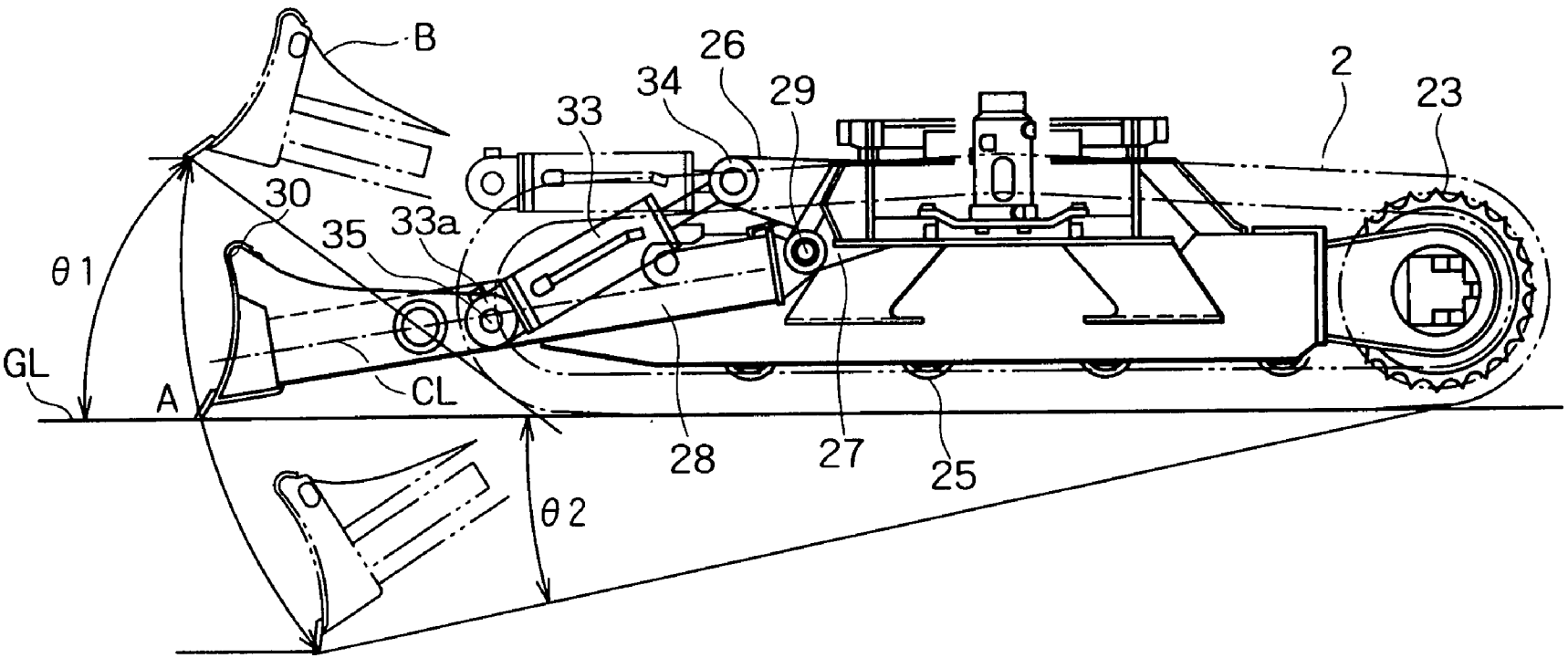

FIGS. 2A and 2B show the lower traveling body 3 including the dozer device 4 in an enlarged scale, FIG. 2A being its plan view, and FIG. 2B being its front view. In FIG. 2A, the right side of the frame is omitted.

In both the above views, a left-side frame 21 is arranged on the left side of a lower frame 20 of the lower traveling body 3. An idler 22 is rotatably supported in front of the left-side frame 21. The crawler shoe 2 as a non-track is stretched from the idler 22 to a sprocket 23 arranged at the rear of the left-side frame 21.

The sprocket 23 is driven by a hydraulic travel motor 24. A plurality of lower rollers 25 are disposed under the left-side frame 2, whereas an upper roller (not shown) for guiding the upper side of the crawler shoe 2 is provided thereabove.

The structure of the dozer device 4 according to the present invention will be described hereinafter.

The dozer device 4 is provided on either frontward or backward direction of the lower frame 20. It is connected to brackets 26, 26 provided as projecting forward from the lower frame 20, and brackets 27, 27 likewise formed projecting forward from the lower frame 20 and arranged under the brackets 26.

Base ends 28*a*, 28*a* of the arms arranged in parallel are connected to a pair of brackets 27, 27 through connection pins 29.

Dozer blade 30 is fixed to the extreme ends of the arms 28, 28. Further, the arms 28 are connected to each other in the width direction by a connection frame 31, Further, the arms 28 and a dozer blade 30 is connected by a reinforcing frame 32.

A dozer cylinder 33 is mounted in the central portion of the brackets 26 and the connection frame 31, and the lower frame side and the dozer blade side are connected by a connection pin 34 and a connection pin 35, respectively. Numeral 31*a* denotes a bracket disposed on the connection frame 31, which is constituted as connecting a tube-side boss of the dozer cylinder 33 is connected through the connection pin 35.

With the dozer cylinder 33 telescopic, the dozer blade 30 can be swung in a vertical direction (direction toward arrow A) with the connection pin 34 as a fulcrum.

More specifically, the arms 28 and the dozer cylinder 38 are arranged so that an approach angle θ1 when the dozer cylinder 33 is contracted to raise the dozer blade 30 to an upper limit from the ground level GL (in the drawing, B position shown by the dash-dotted contour lines) is 35 degrees or more, preferably, 38 degrees or more, and an angle θ2 rotating downward from the ground level GL is approximately 12 degrees similar to background art.

Here, as in FIG. 2B, the approach angle is an angle between the ground and a plane in contact, in a tangential direction, with the front circumferential surface of the crawler shoe 2 passing through the lower end of the blade when the dozer blade 30 is placed at its highest position.

The arrangement of the connection pins 29, 34 and 35 is determined so that the dozer cylinder 33 assumes an approximately horizontal position in its longitudinal direction when the dozer blade 30 is in the B-position of its upper limit.

The dozer cylinder 33 is placed in an approximately horizontal position when the dozer blade 30 is in the upper limit as described above due not to interfere with the bottom of the upper rotating body above the dozer cylinder 33.

Accordingly, even if the dozer blade 30 is raised at maximum, the dozer cylinder 33 maintains an approximately horizontal attitude, and therefore there is no possible interference with the bottom of the upper rotating body 5, the swing bracket 9 at the front and the counterweight at the rear, and thus the dozer blade 30 can be raised or lowered without any anxiety.

In a case of no application of the invention, for example, when the dozer device 4 is positioned forward with respect to the travel direction, for example, the swing bracket 9 or the frame support bracket 8 is positioned thereabove. Accordingly, when the dozer cylinder 33 is gradually inclining upward when the dozer blade 30 is raised, it interferes with the brackets.

In this regard, according to the present embodiment, the dozer cylinder 33 is kept in an approximately horizontal attitude so as not to interfere with the brackets even in the state that the dozer blade 30 is raised up to the upper limit.

Further, when the dozer device 4 is positioned at the rear with respect to the travel direction, the counterweight 7 is positioned thereabove. Even in this case, if the dozer cylinder 33 is kept in an approximately horizontal attitude when the dozer blade 30 is raised up to the upper limit as described above, it will not interfere with the counterweight 7. Thereby, an operator is able to rise or lower the dozer blade 30 without any anxiety for collision with the counterweight 7.

Figure 3:
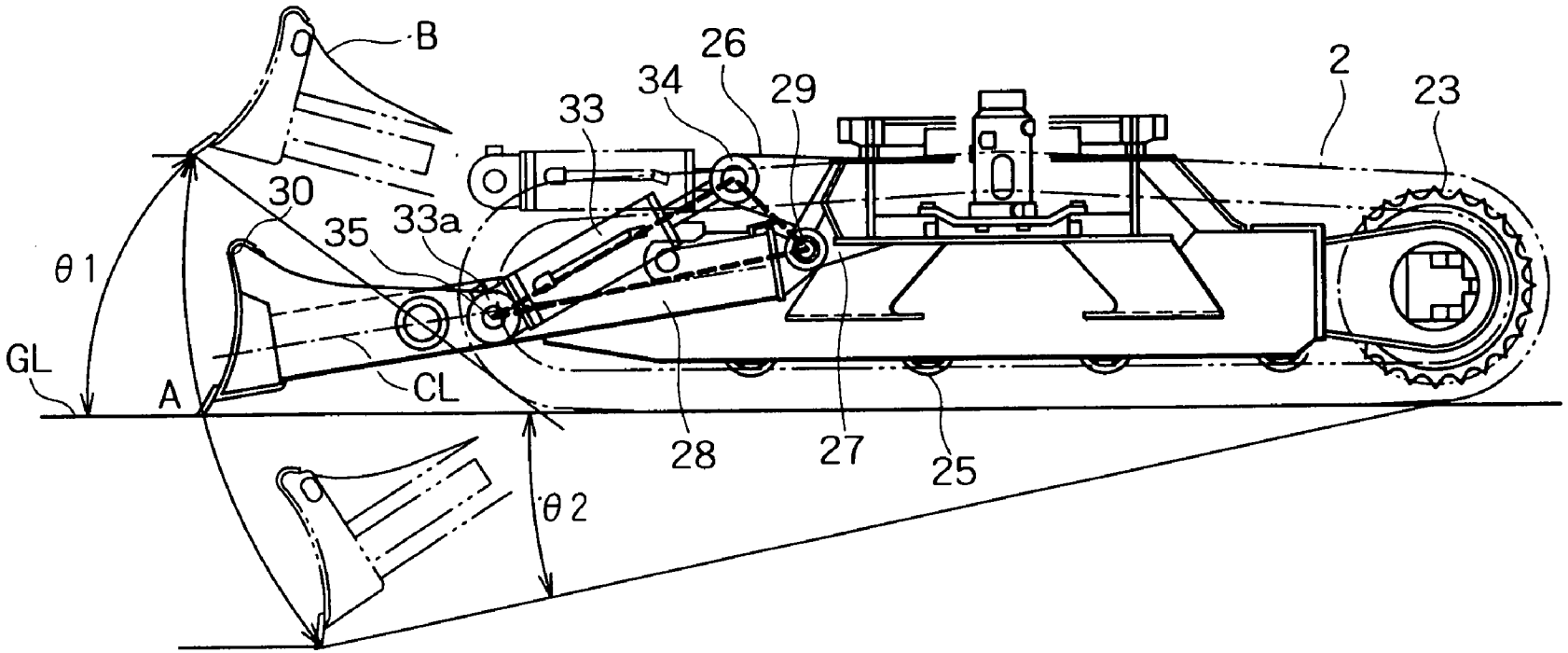
FIG. 3 is an explanatory view for explaining an arrangement relationship between a dozer cylinder 33 and an arm 10 in FIG. 2B.

From the foregoing, the present invention provides a hydraulic excavator with a dozer device provided with a dozer device comprising an upper rotating body 5 rotatably mounted on a lower traveling body 3, an arm 28 a rear end (one end) of which is connected to a fulcrum portion provided on a lower frame 20 of the lower traveling body 3, a dozer blade 30 provided at a front end (the other end) of the arm 28, and a dozer cylinder 33 for vertically swinging the arm 28. Further, the dozer cylinder 33 and the arm 28 are arranged so that the dozer cylinder 33 and the arm 28 form two sides of a triangle as viewed from the side (see the dotted line portion in FIG. 3), the dozer cylinder 33 is prevented from interfering with the bottom of the upper rotating body 5 when the arm 28 is swung in its full range, and when the dozer blade 30 which is moved vertically by the arm 28 assumes the highest position the approach angle is set to 35 degrees or more.

Next, the reason why the approach angle θ1 is set to 35 degrees or more, particularly 38 degrees or more will be described hereinafter.

Table 1 shows the results of investigation of the repose angle (angle of repose) of a sand hill brought down from a dump truck and stacked.

TABLE 1

| Kind | Actual measured angle |
|---|---|
| Decomposed granite soil | 23~30° |
| Sand | 36° |
| Sand at Kyushu (high gravity) | 38° |
| Gravel | 35° |
| Gravel of small grains | 30° |

From Table 1, an angle of the hill is variable depending upon the gravity or the size of grains, but the repose angle of the sand hill is approximately 34 degrees on an average.

Soil which is pushed by the hydraulic excavator in a work site is normally soil in which gravel and sand are mixed, and even if it is even gravel of grains, its repose angle is 35 degrees. Investigation was made of whether the repose angle is affected by the size of a hill. Comparing the hill brought down from twenty 11-ton dump trucks and stacked, with a hill for one 11-ton dump truck, repose angle for both the hills are the same 35 degrees. Therefore, θ may be set to 35 degrees or more.

Further, comparison was made of influences exercised by gravity of normal sand and sand of high gravity (for example, sand at Kyushu district in Japan). In normal sand, repose angle was 36 degrees, whereas in sand at Kyushu district, 38 degrees. It is understood from this fact, that there occurs a slight difference in angle depending upon the difference of gravity.

According to the results of investigation as mentioned above, there was no sand, other than sand of the site such as Kyushu district having high gravity, whose repose angle exceeds 36 degrees. From a viewpoint of this, if the approach angle θ1 of the dozer device 4 is set to 35 degrees or more, it is possible to climb over the hill stacked up in the work site.

Considering sinking caused by own weight of the hydraulic excavator when climbing over the hill it is sometimes possible that the hill is sometimes somewhat dug at the time of climbing over, suppose that with the approach angle θ1 of 35 degrees. Accordingly, the approach angle θ1 is preferably set to 38 degrees in order to climb over the hill stacked up without digging it.

Returning to FIGS. 2A and 2B, a description will be made.

In mounting the dozer device 4 on the lower frame 20, where the approach angle θ1 is intended to secure 35 degrees or more, specifically 38 degrees or more, it is advantageous to connect the tube side 33*a* of the dozer cylinder 33 at the side lower than the center line CL of the arm 28.

However, in background art, when the connection pin 35 is arranged low near the ground level GL, the connection pin 35 comes in contact with the gravel or the like on the ground resulting in brittle, and the dozer cylinder 33 itself also possibly becomes brittle. Also, when the dozer device 4 is assembled, mounting work of the connection pin 35 has to be carried out in a narrow space between the arms 28, thus making it difficult to do the assembling work.

Therefore, in the present embodiment, the approach angle θ1 of 35 degrees is to be secured in the state that the connection pin 35 is arranged on the center line CL of the arm 28 or thereabove.

The dozer cylinder 33 and the arms 28 connected by the connection pin 35 on the basis of the aforementioned arrangement are unavoidably an acute angle, and therefore the drive force in excess of that of the conventional dozer cylinder is required to raise the dozer blade 30. On the contrary, in the present embodiment, a hydraulic cylinder having a larger diameter and shorter overall length than the normal hydraulic cylinder is used in order not to interfere with the bottom of the upper rotating body even in the state that the dozer blade 30 is raised to the upper limit, and in order to compensate for the driving force.

Further, in mounting the dozer device 4 on the lower frame 20, mounting position of the brackets 26 and 27 on the lower frame side can be adjusted in the range not beyond the restriction in terms of construction.

Although the invention has been described with reference to the preferred embodiments in the attached drawings, it is noted that equivalents may be employed and substitutions made herein without departing from the scope of the invention as recited in the claims.

We claim:

1. A hydraulic excavator comprising:

a lower traveling body having a lower frame;

an upper rotating body rotatably mounted on said lower traveling body;

an arm one end of which is rotatably connected to said lower frame;

a dozer blade connected to the other end of said arm; and a dozer cylinder adapted to support the arm in such a manner that the arm swings in a vertical direction in such a range that the arm does not interfere with a bottom of said upper rotating body, wherein said dozer cylinder and said arm are arranged so as to form two sides of a triangle from a side view of the excavator, and an approach angle when said dozer blade vertically moving through said arm is raised to an upper limit position is set to 35 degrees or more.

2. The hydraulic excavator according to claim 1, wherein said dozer cylinder has an approximately horizontal attitude in a state that said dozer blade is raised to said upper limit position.

3. The hydraulic excavator according to claim 1, wherein the approach angle when said dozer blade vertically moving through said arm is raised to an upper limit position is set to 38 degrees or more.

4. A hydraulic excavator comprising:

a lower traveling body having a lower frame;

an upper rotating body rotatably mounted on said lower traveling body;

an arm one end of which is rotatably connected to said lower frame;

a dozer blade connected to the other end of said arm; and a dozer cylinder adapted to support the arm in such a manner that the arm swings in a vertical direction in such a range that the arm does not interfere with a bottom of said upper rotating body, wherein said dozer cylinder and said arm are arranged so as to form two sides of a triangle from a side view of the excavator, and an approach angle when said dozer blade vertically moving through said arm is raised to an upper limit position is dependent on the angle of repose of granular material upon which the hydraulic excavator can travel and has a value greater than the angle of repose of granular material upon which the hydraulic excavator can travel, wherein the approach angle when said dozer blade vertically moving through said arm is raised to an upper limit position is set to 35 degrees or more.

5. The hydraulic excavator according to claim 4, wherein said dozer cylinder has an approximately horizontal attitude in a state that said dozer blade is raised to said upper limit position.

6. The hydraulic excavator according to claim 4, wherein the approach angle when said dozer blade vertically moving through said arm is raised to an upper limit position is set to 38 degrees or more.

* * * * *